US008642889B2

(12) United States Patent
Jansen et al.

(10) Patent No.: US 8,642,889 B2
(45) Date of Patent: Feb. 4, 2014

(54) WIRE CONSTRUCTION FOR CABLES HAVING INSULATION AND FUNCTIONALITY APPLYING IN CASE OF FIRE

(75) Inventors: Hermann-Josef Jansen, Eschweiler (DE); Benjamin Kluge-Engel, Langerwehe (DE); Michael Ingenhaag, Stolberg (DE); Walter Sonnenschein, Wassenberg (DE); Michael Kittler, Bocholtz (NL)

(73) Assignee: Prysmian Kabel und Systeme GmbH, Eschweiler (DE)

( * ) Notice: Subject to any disclaimer, the term of this patent is extended or adjusted under 35 U.S.C. 154(b) by 482 days.

(21) Appl. No.: 12/995,396

(22) PCT Filed: May 29, 2009

(86) PCT No.: PCT/EP2009/003863

§ 371 (c)(1),
(2), (4) Date: Feb. 22, 2000

(87) PCT Pub. No.: WO2009/146858

PCT Pub. Date: Dec. 10, 2009

(65) Prior Publication Data

US 2011/0139487 A1 Jun. 16, 2011

(30) Foreign Application Priority Data

May 30, 2008 (DE) ..... 10 2008 026 062

(51) Int. Cl.
*H01B 7/00* (2006.01)

(52) U.S. Cl.
USPC ..... 174/110 R; 174/113 R; 174/120 R; 174/121 R; 174/121 A

(58) Field of Classification Search
USPC .. 174/110 R, 113 R, 110 SC, 120 R, 120 SC, 174/121 R, 121 SC
See application file for complete search history.

(56) References Cited

U.S. PATENT DOCUMENTS

| | | | | |
|---|---|---|---|---|
| 4,806,416 | A * | 2/1989 | Puzo | 442/266 |
| 7,304,245 | B2 * | 12/2007 | Alexander et al. | 174/110 R |
| 2003/0199623 | A1 | 10/2003 | Demay et al. | |
| 2006/0237215 | A1 | 10/2006 | Alexander et al. | |
| 2008/0124544 | A1 | 5/2008 | Alexander et al. | |

FOREIGN PATENT DOCUMENTS

| | | | | |
|---|---|---|---|---|
| DE | 195 17 392 | A1 | 11/1996 | |
| DE | 197 17 645 | A1 | 10/1998 | |
| DE | 197 17 645 | C2 | 1/2001 | |
| DE | WO2004/088676 | A * | 10/2004 | H01B 7/295 |
| EP | 1 347 464 | A1 | 9/2003 | |
| JP | 2002-231068 | | 8/2002 | |
| WO | WO-2004/088676 | A1 | 10/2004 | |

OTHER PUBLICATIONS

International Search Report from the European Patent Office for International Application No. PCT/EP2009/003863 (Mail date Oct. 15, 2009).

* cited by examiner

*Primary Examiner* — William H Mayo, III
(74) *Attorney, Agent, or Firm* — Finnegan, Henderson, Farabow, Garrett & Dunner, L.L.P.

(57) ABSTRACT

A wire for use in electric cables, has a fire-resistant insulation based on cross-linkable polymers including ceramic-forming additives. The insulation surrounds a conductor, wherein the insulation has a first layer of a first composition, and a second layer of a second composition surrounding the outside of the first layer, the first and the second compositions including different ceramic forms in the composition because the second outer layer is formed at a lower temperature range than the composition of the inner first layer.

8 Claims, 1 Drawing Sheet

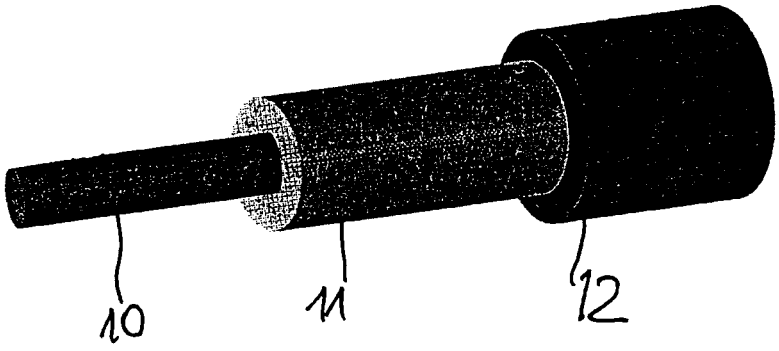
10
11
12

WIRE CONSTRUCTION FOR CABLES HAVING INSULATION AND FUNCTIONALITY APPLYING IN CASE OF FIRE

CROSS REFERENCE TO RELATED APPLICATION

This application is a national phase application based on PCT/EP2009/003863, filed May 29, 2009, the content of which is incorporated herein by reference.

BACKGROUND OF THE INVENTION

1. Field of the Invention

The invention relates to a wire for use in electrical cables with fire-resistant insulation of its inner conductor.

2. Description of the Related Art

Such a wire has been described, for example, in the DE 197 17 645 C2 with regard to the technical background and also with regard to the design of correspondingly fire-resistant compositions, thus ensuring insulation and functional integrity of the wire or a cable based on it in case of a fire. Where wires of this kind are employed in electrical cables a layer manufactured from a correspondingly fire-resistant composition is normally applied to the conductor, which then forms the basis for further sheathing of the wire consisting of further insulation layers and/or layers from a respectively suitable sheathing material. The individual wires are normally grouped together to form multi-wire stranded cores which can be used for the manufacture of electrical cables with improved behaviour in case of fire as regards their insulation and functional integrity.

Further, an optical cable with an optical wave guide is known from DE 195 17 392 A1 in whose cable sheath is provided an inner protective layer from a heat-resistant material such as glass and/or ceramic and/or mica, such that after flaming it forms a tube-shaped structure for protecting the optical wave guide, wherein a further outer sheathing layer consists of a fire-retarding material, in particular a FRNC material. Such a construction of the sheath may not be sufficient if the stress in case of a fire is very high.

SUMMARY OF THE INVENTION

The invention is based on the object to improve the insulation and functional integrity in case of fire for a wire of the kind mentioned in the beginning.

The solution to this object including any advantageous designs and further developments of the invention results from the contents of the patent claims which are appended to this description.

According to the invention the wire is constructed from a first inner layer surrounding the conductor and consisting of a first composition, and a further second layer surrounding the first layer and consisting of a second composition, wherein the forming of a ceramic in the second composition forming the second outer layer takes place in a lower temperature range than in the composition forming the first inner layer.

The invention has the advantage that as the temperature starts to make its impact in case of fire, ceramisation of the second outer layer begins and takes place in a lower temperature range, wherein the conductor, when the upper temperature limit for ceramisation of the second outer layer is reached, is not in contact with this layer but is insulated, rather, from the inner first layer consisting of a composition with a higher ceramisation temperature range and directly surrounding the conductor. If for a further rise in temperature arising from the continuing impact of the fire the rising temperature impacts upon the wire construction according to the invention, corresponding ceramisation of the first inner layer in the higher temperature range applicable to its composition will eventually take place after ceramisation of the outer second layer thereby ensuring not only an improved absolute protection of the conductor against the impacting temperature but also prolonging the time of the entire ceramisation process across both layers and thus the protection of the conductor against the temperature influence.

Preferably ceramising fillers are used as ceramic-forming additives such as described, for example, in the DE 197 17 645 C2, wherein these substances may be used either in their pure form or in the form of composites, wherein, for example, different ceramisation temperatures of the ceramic-forming additives may be set through the use of suitable composites. This would include the precursors of ceramising fillers, i.e. substances which when subjected to heat, change to become corresponding ceramising fillers, for example. Through their use also different ceramising temperatures may be set for the ceramic-forming additives which are to be introduced into the layers of the cable insulation.

The invention also includes incorporating the formation of glasslike coatings on the ceramic surfaces formed by the impact from the temperature by adding suitable glass formers such as described also in the DE 197 17 645 C2. Here again these will permit to ultimately set those different temperature levels at which formation of the protective sheath takes place within the two layers of wire insulation in case of a fire impact.

The invention may be realized, for example, with filled silicone compositions and EPR-based compositions with glass formers.

In conclusion, the invention may be realized with any compositions known to the average expert which are suitable and can be individually selected for the respective requirements, meaning that the actual structure of the composition for forming the two layers in individual cases is not important. The expert may utilize any known basic materials for forming the insulation as long as he makes sure that the compositions forming the two different layers contain additives, which ceramise in different temperature ranges.

Specifically provision is made in one embodiment of the invention for the ceramic formed in the outer second layer to take place within a temperature range of between 200° Celsius and 600° Celsius and in the inner layer in a temperature range above 600° Celsius.

The above mentioned temperature ranges are to be understood as examples only. Depending upon the technical requirements with regard to the resistance to fire of cable insulations or wire insulations other temperature ranges for ceramisation of the ceramic-forming additives may be selected in individual cases, for example a ceramising temperature of 700° Celsius in the outer second layer and a ceramising temperature of 900° Celsius in the first inner layer. As regards setting the temperature ranges, the expert has different basic elements at his disposal, as a rule on the basis of cross-linkable polymers, and different ceramising additives and their composites, as described.

Provision may also be made for applying at least one further layer of an insulating material and/or a sheathing material onto the fire-resistant insulation.

In a basically known manner the inner conductor may be a blank or metal-surrounded copper conductor or a single-strand, multi-strand or fine-strand copper conductor.

BRIEF DESCRIPTION OF THE DRAWING

The accompanying drawing is a schematic illustration of the wire of the present invention.

DETAILED DESCRIPTION OF THE INVENTION

As revealed in the schematic illustration of a generic wire construction in the drawing, an inner conductor 10 is surrounded by a first inner layer 11, wherein the inner first layer 11 is surrounded by a second outer layer 12. The two layers 11 and 12 respectively consist of different compositions on the basis of cross-linked polymers, which due to their ceramic-forming additives such as fillers and/or glass formers have different temperature ranges for conversion from the elastomer range into the ceramic range. In particular due to adding ceramising mineral fillers or glass formers with different decomposition or melting points it is possible to set the different reaction temperatures necessary for realising the invention in the compositions respectively prepared for forming the two layers 11 and 12. The compositions may be designed in such a way that in the transitional range, the insulations support each other electrically and mechanically. Thus the temperature at which ceramisation of the used fillers starts in the outer second layer 12 is approximately 200° Celsius in one embodiment of the invention, whilst the ceramising temperature of the respectively used different mineral fillers of the inner first layer 11 lies above 600° Celsius.

Further layers of insulation material or sheathing material may be applied on top of these two layers 11 and 12 in order to complete wire construction.

The features of the subject of these documents disclosed in the above description, the patent claims, the abstract and the drawing may be essential both individually as well as in various combinations, for realising the invention in its various embodiments.

The invention claimed is:

1. A wire for the use in electrical cables comprising a fire-resistant insulation comprising cross-linkable polymers with ceramic-forming additives surrounding a conductor wherein the insulation comprises:

a) a first layer comprising a first composition; and b) a second layer comprising a second composition and surrounding the first layer on the outside, wherein the first and the second compositions are formulated such that forming a ceramic in the composition of the second outer layer takes place at a temperature range of between 200° Celsius and 600° Celsius and forming a ceramic in the first layer takes place at a temperature range above 600° Celsius.

2. The wire according to claim 1, further comprising a layer of an insulation material, a sheathing material or an insulation and a sheathing material applied on the fire-resistant insulation.

3. The wire according to claim 1, wherein the conductor comprises copper.

4. The wire according to claim 3, wherein the conductor is a blank copper conductor.

5. The wire according to claim 3, wherein the conductor is a metal-surrounded copper conductor.

6. The wire according to claim 3, comprising a single-strand copper conductor.

7. The wire according to claim 3, comprising a multi-strand copper conductor.

8. The wire according to claim 3, comprising a fine-strand copper conductor.

* * * * *